United States Patent [19]

Wade

[11] 4,149,917

[45] Apr. 17, 1979

[54] CAP SENSITIVE EMULSIONS WITHOUT ANY SENSITIZER OTHER THAN OCCLUDED AIR

[75] Inventor: Charles G. Wade, Lehighton, Pa.

[73] Assignee: Atlas Powder Company, Tamaqua, Pa.

[21] Appl. No.: 848,335

[22] Filed: Nov. 3, 1977

[51] Int. Cl.[2] ..... C06B 31/42

[52] U.S. Cl. ..... 149/56; 149/46; 149/60; 149/61; 149/57

[58] Field of Search ..... 149/2, 61, 46, 60, 56, 149/57

[56] References Cited

U.S. PATENT DOCUMENTS 3,770,522 11/1973 Tomic ..... 149/46 X

*Primary Examiner*—Stephen J. Lechert, Jr.

*Attorney, Agent, or Firm*—Richards, Harris & Medlock

[57] ABSTRACT

Water-in-oil explosive compositions having no sensitizer other than occluded air are provided which are detonable by a standard No. 8 blasting cap and which contain from about 14 to about 17 weight percent water and from about 3 to about 7 weight percent fuel, with the remaining portion comprising inorganic nitrates. The fuel material further comprises from about 0.5% to about 1.5% of a water-in-oil emulsifier, from 0 to about 1% oil, and at least about 2% wax, based upon the weight of the emulsion.

34 Claims, No Drawings

CAP SENSITIVE EMULSIONS WITHOUT ANY SENSITIZER OTHER THAN OCCLUDED AIR

BACKGROUND OF THE INVENTION

This invention relates to water-in-oil emulsion explosive compositions. In another aspect, this invention relates to improved water-in-oil emulsion explosive compositions that contain occluded air, that are detonable by a standard No. 8 blasting cap, and that are made of non-explosive components. A further aspect of this invention relates to water-in-oil emulsion explosives that contain no sensitizer other than occluded air.

Water-in-oil emulsion type blasting agents are disclosed by Bluhm in U.S. Pat. No. 3,447,978. These emulsion type blasting agents contain an aqueous solution of inorganic oxidizer salt which is emulsified as the dispersed phase within a continuous carbonaceous fuel phase, and a uniformly distributed gaseous component. Such emulsion type blasting agents have many advantages over water slurry type blasting agents, but they are not cap sensitive. Therefore, such materials require a booster in order to effect their detonation.

Cattermole et al, in U.S. Pat. No. 28,060 teaches the addition of certain amine nitrate compounds to the water-in-oil emulsion compositions in order to assure that once detonated, the explosion will propagate in a 2 or 3 inch borehole. However, the mere addition of amine nitrates to the conventional water-in-oil emulsion type blasting agents will not render such materials cap sensitive. U.S. Pat. No. 3,770,522 suggests that the addition of materials such as trinitrotoluene, pentaerythritol tetranitrate, and the like, to conventional water-in-oil blasting agents will render them cap sensitive. However, it is well known that such materials are high explosives and are more expensive than conventional ingredients that go into the water-in-oil emulsion blasting agents; also, the resulting products do not adequately perform in small diameter boreholes and are undesirable from other standpoints.

U.S. Pat. Nos. 3,715,247 and 3,765,964 disclose that water-in-oil emulsion explosive compositions can be prepared which retain all the advantages of the emulsion blasting agents described above, but are cap sensitive without the use of an explosive ingredient. These latter two patents disclose the addition of a detonation sensitizer of catalyst, such as an inorganic metal compound of Atomic No. 13 or greater, and strontium compounds.

Therefore, water-in-oil emulsion explosive compositions are needed that achieve cap sensitivity without the use of any sensitizer other than occluded air.

SUMMARY OF THE INVENTION

According to the subject invention, improved water-in-oil emulsion explosive compositions are provided that contain a continuous hydrocarbon fuel phase and a discontinuous water phase containing dissolved inorganic nitrates as the oxidizer and that do not contain explosive ingredients, detonation catalysts, nor sensitizers other than occluded air, yet can be detonated with a No. 8 cap at diameters of 1.25 inches or less. The improved cap sensitive water-in-oil emulsion explosives of the subject invention contain from about 14 to about 17 weight percent water and from about 3 to about 7 weight percent fuel, with the remaining portion comprising inorganic nitrates. The inorganic nitrates utilized in the subject emulsion explosives contain ammonium nitrate and from about 10% to about 20% by weight of the total emulsion of another soluble inorganic nitrate such as sodium nitrate. The fuel component will further contain at least about 2 weight percent wax, from about 0.5 to about 1.5 weight percent of a water-in-oil emulsifier and from 0 to about 1 weight percent oil. The density of the explosive compositions will range from about 0.80 to less than about 1.0 g/cc, and preferably from about 0.90 to about 0.95 g/cc, at the time of manufacture.

DETAILED DESCRIPTION OF THE INVENTION

Thus, I have discovered that water-in-oil emulsion explosive compositions can be made and detonated with at least a No. 8 cap at diameters of 1.25 inches or less by the utilization of hydrocarbon fuels, water, and inorganic nitrates, but without any sensitizer other than occluded air. Other sensitizers utilized in compositions taught by the prior art that are not required in the subject invention include aluminum, carbon black, copper chloride, zinc chloride, high explosives, smokeless powder and the like.

The carbonaceous fuel component utilizable within the scope of this invention can include most hydrocarbons, for example, paraffinic, olefinic, naphthenic, aromatic, saturated or unsaturated hydrocarbons. In general, the carbonaceous fuel is a water immiscible emulsifiable fuel which is either liquid or liquefiable at a temperature up to about 200 degrees F. and preferably between 110 degrees F. and about 160 degrees F. It is preferable that the emulsion comprise from about 3 to about 7% by weight of the fuel and that the fuel include wax, emulsifier and optionally, an oil. The water-in-oil emulsion should contain at least about 2 weight percent wax, from about 0.5 to about 1.5 weight percent emulsifier, and from 0 to about 1 weight percent oil.

Examples of suitable waxes include waxes derived from petroleum such as petrolatum wax, microcrystalline wax and paraffin wax; mineral waxes such as ozocerite and montan wax; animal waxes such as spermacetic wax; and insect waxes such as beeswax and Chinese wax. Preferred waxes include waxes identified by the trade designations INDRA 1153 and INDRA 2119 sold by Industrial Raw Materials Corporation. Examples of suitable oils include the various petroleum oils, vegetable oils, dinitrotoluene, and a highly refined mineral oil sold by Atlantic Refining Company under the trade designation ATREOL.

The carbonaceous fuel component will also include the emulsifier that is used within the scope of the invention. The emulsifier is a water-in-oil emulsifier such as those derivable from sorbitol by esterification with removal of one molecule of water such as sorbitan, fatty acid esters, for example, sorbitan monolaurate, sorbitan monooleate, sorbitan monopalmitate, sorbitan monostearate, and sorbitan tristearate. Other useful materials comprise mono- and diglycerides of fat-forming fatty acids, as well as polyoxyethylene sorbitol esters such as polyethylene sorbitol beeswax derivative materials and polyoxyethylene(4)lauryl ether, polyoxyethylene(2)ether, polyoxyethylene(2)steryl ether, polyoxyalkylene oleate, polyoxyalkylene laurate, oleyl acid phosphate, substituted oxazolines and phosphate esters and mixtures thereof, and the like.

The water-in-oil emulsions of the subject invention can contain from about 14% to about 17% by weight water. The emulsions of the subject invention will generally comprise two different inorganic oxidizer salts. While the principal preferred inorganic oxidizer salt is ammonium nitrate, the emulsions will further comprise from about 10% to about 20% of another inorganic nitrate such as an alkali or alkaline earth metal nitrate, based upon the weight of the total composition. In general, the explosive compositions of the subject invention are sensitive to a standard No. 8 blasting cap at ambient conditions or lower and have excellent storage stability. These emulsions have exhibited No. 8 cap sensitivity after being stored for several months.

The improved emulsions of the subject invention are preferably made by premixing the water and the inorganic oxidizer salts in a first premix, and the carbonaceous fuel and emulsifier in a second premix. The two premixes are then heated, if necessary. The first premix is generally heated until the salts are completely dissolved (about 120 to 205 degrees F.), and the second premix is heated until the carbonaceous fuel has liquefied (generally about 120 degrees F. or more for the wax materials). The premixes are then blended together and emulsified. In the continuous manufacture of the emulsion compositions, it is preferable to prepare an aqueous solution containing the oxidizers in one tank and to prepare a mix of the organic fuel components, excluding the emulsifier, in another tank. Thereafter, the two liquid mixes and the emulsifier are pumped separately to a mixing device wherein they are emulsified. The resulting emulsion is then packaged through a Bursa filler or other conventional device into cartridges of desired diameters. According to a preferred embodiment of the invention, the emulsion explosive compositions thus formed are packaged in polyethylene bags or paper cartridges.

In general, the subject emulsions are made at a density ranging from about 0.80 to less than about 1.0 g/cc, and preferably from about 0.90 to about 0.95 g/cc, if they are not to be detonated within about 24 hours after manufacture. The density of the emulsion is controlled by regulating the amount of gas occluded within the carbonaceous fuel phase. The gas, preferably air, is occluded within the carbonaceous fuel by means of a mixing device such as that disclosed in U.S. Pat. No. 3,642,547. The air is added as the carbonaceous fuel passes through a mixing zone across which there is a pressure drop at at least about 5 psi, and preferably about 25 psi. The density of the product can be changed almost instantaneously by changing the flow rate of the gas stream entering the system. At least about 2% wax by weight of the total composition is required in the carbonaceous fuel to facilitate the occlusion of sufficient air within the emulsion. The density of the emulsion as it leaves the mixer is referred to as the "dump density". If the dump density of the subject emulsions is greater than about 1.0 g/cc, they will not detonate with a No. 8 blasting cap after aging for more than about 24 hours. If, however, the emulsions are manufactured with a dump density less than about 1.0 g/cc and are subsequently allowed to age to a density greater than about 1.0 g/cc, they will remain No. 8 cap sensitive.

The following examples are set forth in order to more fully describe the present invention. However, it is to be understood that the examples are for illustrative purposes only and are not to be construed as unduly limiting the scope of the invention.

EXAMPLE 1

To prepare an emulsion explosive of the present invention, 60 parts of ammonium nitrate, 19 parts of sodium nitrate, and 15 parts water were first premixed with water and solubilized at a temperature of 146 degrees F. A second premix of carbonaceous fuel and emulsifier was then prepared and solubilized at 130 degrees F. The carbonaceous fuel comprised 4.5 parts of INDRA 1153, a wax sold by Industrial Raw Material Corporation, and 0.5 parts of ATREOL 34, a mineral oil sold by Atlantic Refining Company. The emulsifier comprised 1 part of ATMOS 300, a glyceride water-in-oil emulsifier sold by ICI, U.S. The first premix was then slowly added to the second premix with agitation to obtain the water-in-oil emulsions of the subject invention. The composition was agitated long enough to occlude sufficient air within the emulsion to reduce its dump density to 0.95 g/cc.

The resulting emulsion was packaged in cartridges having a diameter of 1.25 inches, sealed and stored. Sensitivity tests were performed at one, two and four weeks after manufacture, and every four weeks thereafter. The sensitivity tests on this composition were conducted at 70 degrees F. The material detonated successfully with a No. 6 cap after two months and was still detonating with a No. 8 cap after eight months, at which time the supply of the material was exhausted.

EXAMPLE 2

Another composition was prepared by again premixing 60 parts of ammonium nitrate, 19 parts sodium nitrate and 15 parts water in a first premix at 160 degrees F. A second premix of carbonaceous fuel and emulsifier was then prepared at 130 degrees F. The carbonaceous fuel again consisted of 4.5 parts INDRA 1153, 0.5 parts ATREOL 34 and 1 part ATMOS 300. The first premix was slowly added to the second premix with agitation to obtain the water-in-oil emulsion of the subject invention. Mising was controlled so that a dump density of 0.90 g/cc was achieved. The resulting product was then packaged in cartridges having a diameter of 1.25 inches, sealed and stored.

The cartridges were successfully detonated by No. 8 blasting caps at one, two and four weeks after manufacture, and every four weeks up to 40 weeks thereafter. These sensitivity tests were conducted at ambient conditions.

The above Examples illustrate that extremely sensitive explosives in the form of water-in-oil emulsions containing no sensitizer other than occluded air can be made in accordance with the subject invention. The explosive compositions disclosed herein are at least sensitive to conventional No. 8 blasting caps and are suitable for detonation in small diameters of 1.25 inches or less. Furthermore, the explosive compositions taught herein are suitable for use as primers for other less sensitive explosives.

Thus, I have discovered that water-in-oil emulsion explosive compositions can be made No. 8 cap sensitive without the use of any sensitizer other than occluded air. The subject water-in-oil emulsions are sensitized without the use of conventional high explosives, detonation catalysts, microballoons or other sensitizers, but yet are able to achieve cap sensitivity at low temperatures and to retain that sensitivity for prolonged periods of time. Furthermore, they will not produce headaches; they possess water resistance as an intrinsic property of their physical forms; they are safe against initiation by fire, rifle bullet, impact, friction or static electricity; they lend themselves to continuous processing and can be extruded during manufacture; and they are non-corrosive, that is, they are not severely acidic or basic.

While this invention has been described in relation to its preferred embodiments, it is to be understood that various modifications thereof will be apparent to those of ordinary skill in the art upon reading the specification and it is intended to cover all such modifications as fall within the scope of the appended claims.

I claim:

1. A cap sensitive emulsion explosive composition having a continuous carbonaceous fuel phase and a discontinuous water phase containing dissolved inorganic nitrates, said composition consisting essentially of:
(a) ammonium nitrate;
(b) from about 3% to about 7% by weight of a carbonaceous fuel comprising at least about 2% by weight wax, from about 0.5 to about 1.5% by weight of an emulsifier, and from 0 to about 1.0% by weight oil;
(c) from about 14% to about 17% by weight water;
(d) from about 10% to about 20% by weight of an inorganic nitrate other than ammonium nitrate; and
(e) a minor effective amount of occluded air to reduce the density of said composition to a level ranging from about 0.80 to less than about 1.0 g/cc at the time of manufacture.

2. The explosive composition of claim 1 wherein the inorganic nitrate of part (d) is selected from the group consisting of the alkali and alkaline earth metal nitrates.

3. The explosive composition of claim 2 wherein the inorganic nitrate is sodium nitrate.

4. The explosive composition of claim 1 wherein the carbonaceous fuel comprises water immiscible emulsifiable material selected from the group consisting of petrolatum; microcrystalline, paraffin, mineral, animal and insect waxes; petroleum oils, vegetable oils, dinitrotoluene, and mixtures thereof.

5. The explosive composition of claim 1 wherein the emulsifier is selected from the group consisting of those derivable from sorbitol by esterification with removal of one molecule of water such as sorbitan, fatty acid esters, for example, sorbitan monolaurate, sorbitan monooleate, sorbitan monopalmitate, sorbitan monostearate, and sorbitan tristearate; and mono- and diglycerides of fat-forming fatty acids, as well as polyoxyethylene sorbitol esters, such as polyethylene sorbitol beeswax derivative materials and polyoxyethylene(4)lauryl ether, polyoxyethylene(2)ether, polyoxyethylene(2)steryl ether, polyoxyalkylene oleate, polyoxyalkylene laurate, oleyl acid phosphate, substituted oxazolines and phosphate esters, and mixtures thereof.

6. The explosive composition of claim 1 wherein the density at the time of manufacture ranges from about 0.90 g/cc to about 0.95 g/cc.

7. An emulsion explosive composition detonable at ambient conditions by a standard No. 8 blasting cap in a cartridge diameter of 1.25 inches and containing a continuous carbonaceous fuel phase and a discontinuous water phase having inorganic nitrates dissolved therein, said composition consisting essentially of:
(a) ammonium nitrate;
(b) from about 3% to about 7% by weight of a carbonaceous fuel comprising at least 2% by weight wax, from about 0.5% to about 1.5% by weight of an emulsifier, and from 0 to about 1.0% by weight oil;
(c) from about 14% to about 17% by weight water;
(d) from about 10% to about 20% by weight of an inorganic nitrate other than ammonium nitrate; and
(e) a minor effective amount of occluded air to reduce the density of said composition to a level ranging from about 0.80 to less than about 1.0 g/cc at the time of manufacture.

8. The explosive composition of claim 7 wherein the inorganic nitrate of part (d) is selected from the group consisting of the alkali and alkaline earth metal nitrates.

9. The explosive composition of claim 8 wherein the inorganic nitrate is sodium nitrate.

10. The explosive composition of claim 7 wherein the carbonaceous fuel comprises water immiscible emulsifiable material selected from the group consisting of petrolatum; microcrystalline, paraffin, mineral, animal and insect waxes; petroleum oils; vegetable oils, dinitrotoluene, and mixtures thereof.

11. The explosive composition of claim 7 wherein the emulsifier is selected from the group consisting of sorbitan, fatty acid esters, mono- and diglycerides of fat-forming fatty acids, polyoxyethylene sorbitol esters, polyoxyethylene(4)lauryl ether, polyoxyethylene(2)ether, polyoxyethylene(2)steryl ether, polyoxyalkylene oleate, polyoxyalkylene laurate, oleyl acid phosphate, substituted oxazolines and phosphate esters, and mixtures thereof.

12. The explosive composition of claim 7 wherein the density at the time of manufacture ranges from about 0.90 g/cc to about 0.95 g/cc.

13. In a process for making an emulsion explosive composition having a continuous carbonaceous fuel phase and a disperse water phase that is detonable at ambient conditions by a standard No. 8 blasting cap in a cartridge diameter of 1.25 inches, said composition consisting essentially of from about 3% to about 7% by weight of a carbonaceous fuel, from about 14% to about 17% by weight water, from about 10% to about 20% by weight of an inorganic nitrate other than ammonium nitrate, ammonium nitrate, and occluded air, the improvement comprising occluding sufficient air within the composition so that its density at the time of manufacture ranges from about 0.80 to less than about 1.0 g/cc.

14. The product made according to the process of claim 13.

15. The process of claim 13 wherein the density at the time of manufacture ranges from about 0.90 g/cc to about 0.95 g/cc.

16. The product made according to the process of claim 15.

17. The process of claim 13 including the further step of allowing the composition to age for more than 24 hours after removal from the emulsifier.

18. The product made according to the process of claim 17.

19. The process of claim 17 wherein the density of the explosive composition increases to a level greater than 1.0 g/cc during aging.

20. The product made according to the process of claim 19.

21. A process for making an emulsion explosive composition having a continuous carbonaceous fuel phase and a disperse water phase that is detonable by a standard No. 8 blasting cap in a cartridge diameter of 1.25 inches comprising:

(a) combining from about 14% to about 17% water, from about 10% to about 20% of an inorganic nitrate other than ammonium nitrate, and ammonium nitrate in a first premix, by weight of the total composition;

(b) combining at least about 2% wax, from about 0.5% to about 1.5% of an emulsifier, and from 0 to about 1.0% oil, by weight of the total composition, in a second premix;

(c) blending the two premixes together in a mixer; and (d) occluding sufficient air within the composition thus formed so as to achieve a density ranging from about 0.80 to less than about 1.0 g/cc.

22. The product made according to the process of claim 21.

23. The process of claim 21 wherein the two premixes are separately heated prior to emulsification.

24. The product made according to the process of claim 23.

25. The process of claim 21 wherein the first premix is heated until the salts are completely dissolved.

26. The process of claim 25 wherein the first premix is heated to a temperature ranging from about 120 to about 205 degrees F.

27. The process of claim 21 wherein the second premix is heated until the carbonaceous fuel has liquefied.

28. The process of claim 27 wherein the second premix is heated to a temperature greater than about 120 degrees F.

29. The process of claim 21 wherein the density at the time of manufacture ranges from about 0.90 g/cc to about 0.95 g/cc.

30. The product made according to the process of claim 29.

31. The process of claim 21 including the additional step of allowing the composition to age for a period of more than 24 hours between manufacture and use.

32. The product made according to the process of claim 31.

33. The process of claim 31 wherein the density of the explosive composition increases to a level greater than about 1.0 g/cc.

34. The product made according to the process of claim 33.

* * * * *